US009622516B2

(12) United States Patent
Lau

(10) Patent No.: US 9,622,516 B2
(45) Date of Patent: Apr. 18, 2017

(54) GARMENT AND METHOD OF MANUFACTURING SAME

(71) Applicant: Clover Mystique Co. Ltd., Kowloon, Hong Kong (HK)

(72) Inventor: Mun Chee Angela Lau, Hong Kong (HK)

(73) Assignee: Clover Mystique Co. Limited, Hong Kong (HK)

( * ) Notice: Subject to any disclaimer, the term of this patent is extended or adjusted under 35 U.S.C. 154(b) by 350 days.

(21) Appl. No.: 14/291,440

(22) Filed: May 30, 2014

(65) Prior Publication Data

US 2015/0342267 A1 Dec. 3, 2015

(51) Int. Cl.

| | |
|---|---|
| ***A41C 3/00*** | (2006.01) |
| ***A41C 3/14*** | (2006.01) |
| ***A41C 5/00*** | (2006.01) |

(52) U.S. Cl.

CPC ..... *A41C 3/0057* (2013.01); *A41C 3/0014* (2013.01); *A41C 3/144* (2013.01); *A41C 5/00* (2013.01)

(58) Field of Classification Search

CPC .... A41C 3/00; A41C 3/04; A41C 3/08; A41C 3/0057; A41C 3/0014; A41C 3/0007; A41D 14/00

USPC ..... 450/41–45, 65, 678, 36, 50, 51

See application file for complete search history.

(56) References Cited

U.S. PATENT DOCUMENTS

| | | | | | |
|---|---|---|---|---|---|
| 1,890,507 | A | * | 12/1932 | Gifford | A41C 3/08 2/67 |
| 2,305,051 | A | * | 12/1942 | Witkower | A41C 3/04 450/36 |
| 3,392,732 | A | * | 7/1968 | Holscher | A41C 3/00 450/65 |
| 3,537,279 | A | * | 11/1970 | Epley | A41C 3/0014 450/65 |
| 3,698,399 | A | * | 10/1972 | Hand | A41C 3/0021 450/59 |

(Continued)

FOREIGN PATENT DOCUMENTS

| | | | |
|---|---|---|---|
| CN | 2247952 | Y | 2/1997 |
| CN | 102726844 | A | 10/2012 |

(Continued)

OTHER PUBLICATIONS

GB Search Report for corresponding application GB 1411479.7, dated Sep. 10, 2014, 1 page.

(Continued)

*Primary Examiner* — Gloria Hale

(74) *Attorney, Agent, or Firm* — Ware, Fressola, Maguire & Barber LLP

(57) ABSTRACT

A brassiere (100, 102, 200) is disclosed as including a first layer (104, 204), a second layer (106, 206), and a third layer located between the first layer and the second layer. The third layer includes a piece of across-sling fabric (118, 218) and two pieces of side-sling fabric (116, 216) which collectively form a general H-shape. The piece of across-sling fabric extending across and compresses a pair of breasts of a wearer of the brassiere towards a body of the wearer, and the two pieces of side-sling fabric support the pair of breasts of the wearer each from an outer side of the respective breast.

22 Claims, 8 Drawing Sheets

(56) References Cited

U.S. PATENT DOCUMENTS

| | | | | |
|---|---|---|---|---|
| 3,746,007 | A * | 7/1973 | Hand | A41D 10/00 2/73 |
| 4,254,777 | A * | 3/1981 | Johnston | A41C 3/142 450/41 |
| 4,444,192 | A * | 4/1984 | Stern | A41C 3/0007 450/67 |
| 4,698,847 | A * | 10/1987 | Yoshihara | A41B 9/08 2/406 |
| 5,033,986 | A * | 7/1991 | Feigenbaum | A41C 3/0057 2/67 |
| 5,045,019 | A * | 9/1991 | Capasso | A41C 3/00 2/73 |
| 6,846,217 | B1 | 1/2005 | Struble et al. | |
| 7,381,113 | B2 | 6/2008 | Hori | |
| 8,075,368 | B2 * | 12/2011 | Puyaubreau | A41C 3/14 450/65 |
| 8,419,502 | B2 | 4/2013 | Liu | |
| 8,690,634 | B2 * | 4/2014 | Heath | A41C 3/0057 450/40 |
| 8,758,081 | B2 | 6/2014 | Yuasa et al. | |
| 2003/0134567 | A1 | 7/2003 | Smith | |
| 2003/0166375 | A1 | 9/2003 | Noel et al. | |
| 2008/0153388 | A1 * | 6/2008 | Liu | A41C 3/00 450/39 |
| 2009/0081924 | A1 * | 3/2009 | Puyaubreau | A41C 3/14 450/39 |
| 2009/0282603 | A1 | 11/2009 | Kumar | |
| 2012/0122370 | A1 * | 5/2012 | Heath | A41C 3/0057 450/80 |
| 2014/0087624 | A1 | 3/2014 | Yuasa et al. | |

FOREIGN PATENT DOCUMENTS

| | | | |
|---|---|---|---|
| CN | 103298361 | A | 9/2013 |
| GB | 1213591 | A | 11/1970 |
| JP | 2006-104613 | A | 4/2006 |

OTHER PUBLICATIONS

International Search Report for PCT/CN2014/081895, dated Feb. 27, 2015, with Written Opinion, 11 pages.

Search Report for Hong Kong Short-Term Patent Application 15105103.6, Jun. 23, 2015 (5 pages).

* cited by examiner

GARMENT AND METHOD OF MANUFACTURING SAME

TECHNICAL FIELD

This invention relates to a garment article, such as (but not limited to) brassieres (also called "bras"), sports bras, crop tops, bra tops, sports tops, bra pads, and a method of manufacturing such a garment article.

BACKGROUND OF THE INVENTION

It is generally known that when a woman exercises without some form of support to her breasts (such as sports bras, crop tops and sports tops), her breast tissues will move around (most commonly in a figure of eight ("8") motion). This can easily lead to permanent stretching and damage of the breast ligaments, which can become extremely painful. Depending on the impact of the sport/movement in question, it is generally the case that the larger the breast size, the more serious the issue will be.

There are in existence sports tops and bras which seek to solve this problem. One existing approach is "encapsulation" whereby the breast is supported by a three-dimensional support which follows the shape of most of the breast. This is mostly adopted in a molded garment with under wires. Another existing approach is "compression", whereby the entire breast profile is minimized by compressing the surface area of the breast, thus restricting the bouncing movement.

It is found in practice that garments adopting the "encapsulation" approach usually suffer from the drawback of insufficient air-permeability through the garment (i.e. breathability). As for garments adopting the "compression" approach, such usually compress the breasts of the wearer downward, causing discomfort to the wearer or even disfiguring of the breasts.

SUMMARY OF THE INVENTION

It is thus an object of the present invention to provide a garment article and a method of manufacturing such a garment article in which the aforesaid shortcomings are mitigated or at least to provide a useful alternative to the trade and public.

According to a first aspect of the present invention, there is provided a garment article including a first layer, a second layer, and a third layer between said first layer and said second layer, wherein said third layer comprises a first part, a second part and a third part which collectively form a general H-shape, wherein said first part is adapted to extend across and compress a pair of breasts of a wearer of said garment article towards a body of said wearer, and wherein said second part and third part are adapted to support said pair of breasts of said wearer each from an outer side of said respective breast.

According to a second aspect of the present invention, there is provided a method of manufacturing a garment article, including (a) providing a first layer and a second layer, (b) providing a third layer comprising a first part, a second part and a third part, (c) positioning said third layer between said first layer and said second layer such that said first part, said second part and said third part collectively form a general H-shape, and (d) fixedly engaging said first layer, said second layer and said third layer with one another.

BRIEF DESCRIPTION OF THE DRAWINGS

Embodiments of the present invention will now be described, by way of examples only, with reference to the accompanying drawings, in which.

DETAILED DESCRIPTION OF THE PREFERRED EMBODIMENTS

Figure 1:
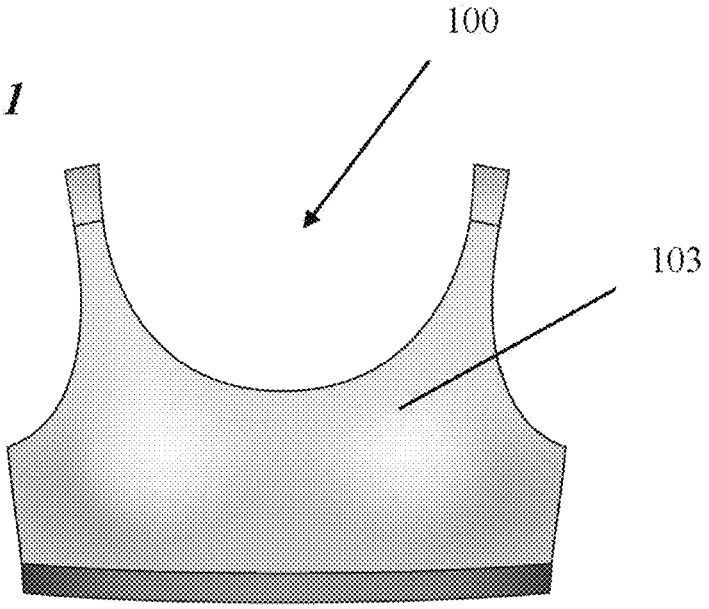
FIG. 1 is a front view of a padded sports brassiere according to a first embodiment of the present invention.
Figure 2:
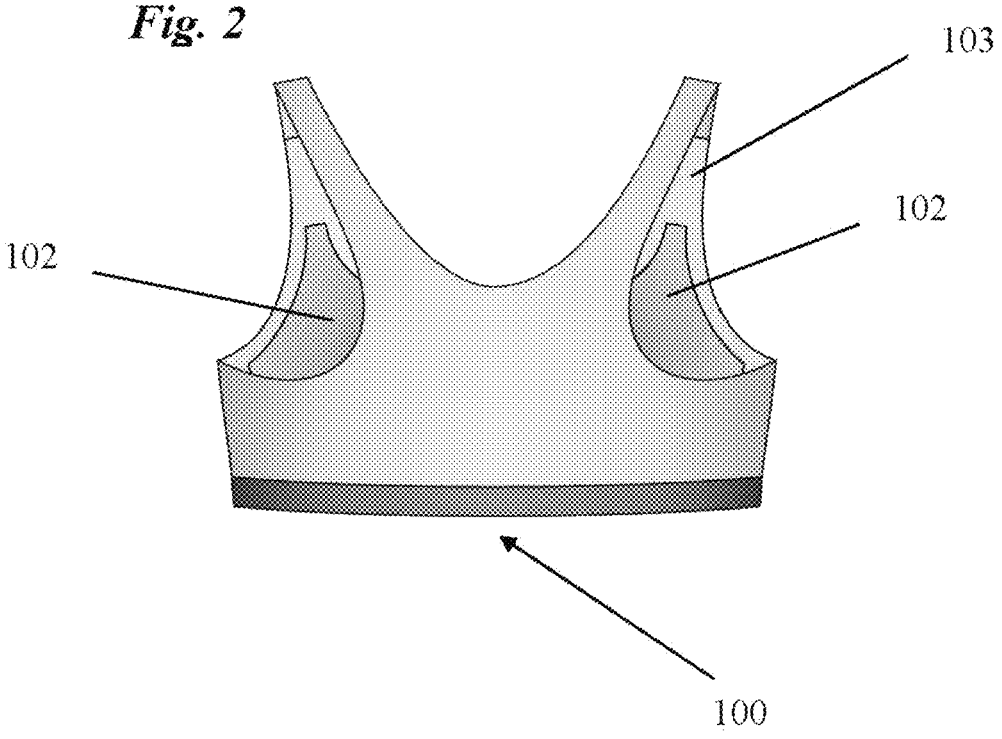
FIG. 2 is a rear view of the sports brassiere of FIG. 1.

A padded sports brassiere accordingly to a first embodiment of the present invention is shown in FIGS. 1 and 2, and generally designated as 100. The padded sports brassiere 100 includes a pair of bra pads 102 fixedly engaged with a front panel 103 of the sports brassiere 100 to provide support to the breasts of a wearer.

Figure 3:
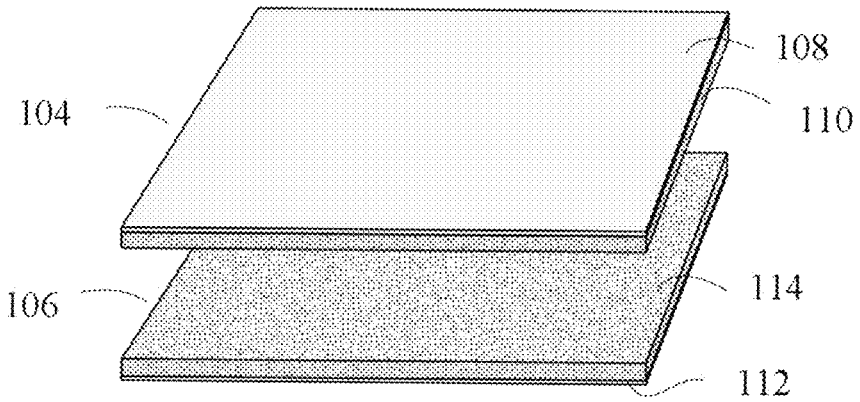
FIGS. 3 to 9 show the steps of manufacturing a pair of brassiere pads for manufacturing the sports brassiere of FIG. 1.

Steps of manufacturing the bra pads 102 are shown in FIGS. 3 to 9. As shown in FIG. 3, an upper laminated layer 104 and a lower laminated layer 106 are provided. The upper laminated layer 104 is formed of a layer of fabric material 108 and a layer of foam material 110 fixedly engaged with each other by heat lamination or an adhesive. Similarly, the lower laminated layer 106 is formed of a layer of fabric material 112 and a layer of foam material 114 fixedly engaged with each other by heat lamination or an adhesive.

Figure 4:
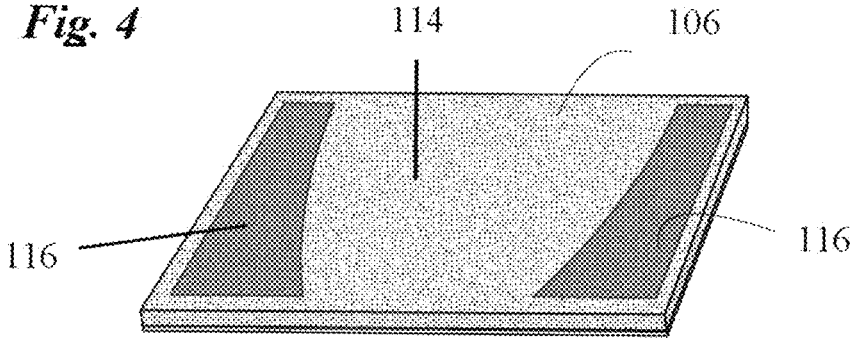
Figure 5:
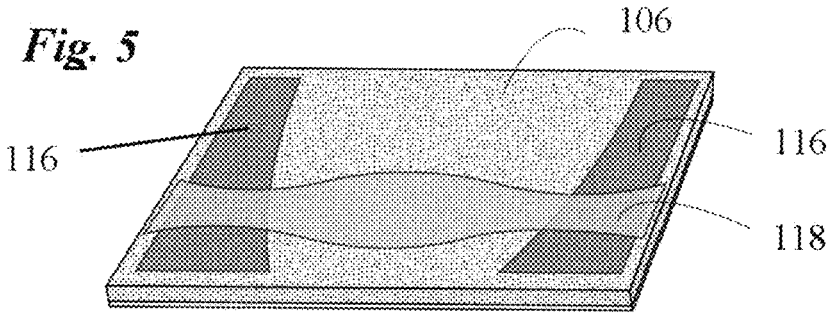

Turning to FIGS. 4 and 5, on the layer of foam material 114 of the lower laminated layer 106 are positioned two pieces of side-sling fabrics 116 and a piece of across-sling fabric 118. It can be clearly seen in FIG. 5 that the piece of across-sling fabric 118 overlaps a respective part of the each of the two pieces of side-sling fabrics 116, and that the piece of across-sling fabric 118 and the two pieces of side-sling fabrics 116 collectively form a general H-shape. Although FIGS. 4 and 5 here show that the two pieces of side-sling fabrics 116 placed on the layer of foam material 114 before the piece of across-sling fabric 118, it should be understood that the piece of across-sling fabric 118 may be placed on the layer of foam material 114 before the two pieces of side-sling fabrics 116.

The two pieces of side-sling fabrics 116 and the piece of across-sling fabric 118 may each be independently made of a rigid material, a semi-rigid material, a material with middle to high modulus and a good recovery, or a combination thereof, such as a material with a modulus of 1.0 to 4.0 pounds at 40% elongation, or 1.0 to 5.0 pounds at 60% elongation and a recovery of over 90%. In particular, such materials may be stabilized block tricot, marquisette fabric, power net, satin net, two-way tricot, triskin fabric, and a combination thereof.

Figure 6:
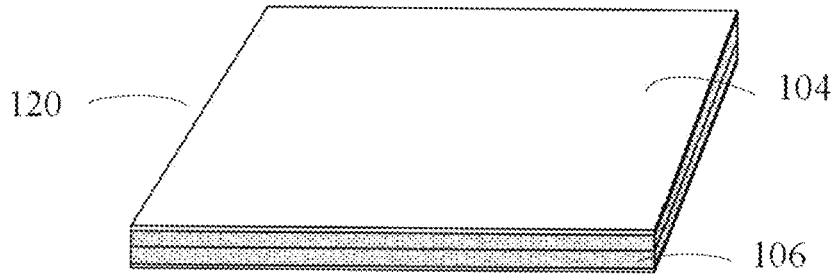

Turning to FIG. 6, the upper laminated layer 104 is then placed on top of the lower laminated layer 106, sandwiching the two pieces of side-sling fabrics 116 and the piece of across-sling fabric 118 there-between. The layer of foam material 110 of the upper laminated layer 104 faces directly and comes into contact with the layer of foam material 114 of the lower laminated layer 106. The upper laminated layer 104 and the lower laminated layer 106 are then fixedly engaged with each other (and thereby fixedly engaging the two pieces of side-sling fabrics 116 and the piece of across-sling fabric 118 with one another and with the upper laminated layer 104 and the lower laminated layer 106) by heat lamination or an adhesive, to form a further laminated layer 120.

Figure 7:
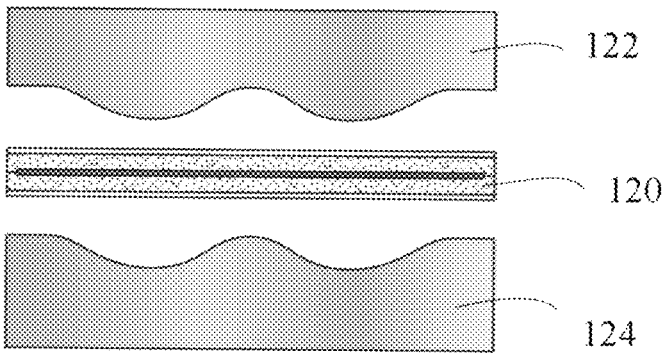
Figure 8:
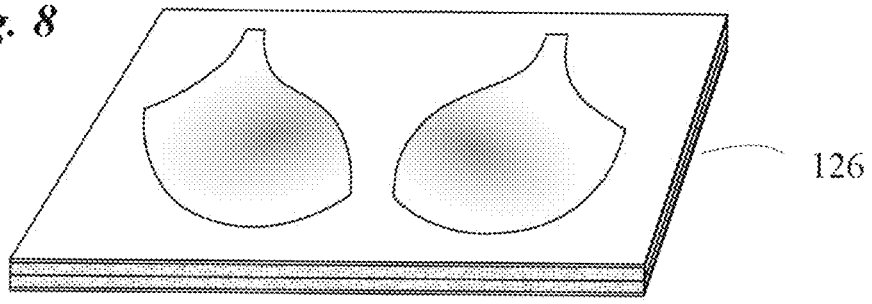

As shown in FIG. 7, the laminated layer 120 is then placed within a mold formed of an upper mold part 122 and a lower mold part 124, to be molded under pressure and/or heat into cup shape, as shown in FIG. 8, which shows the molded laminated layer 126 after release from the mold.

Figure 9:
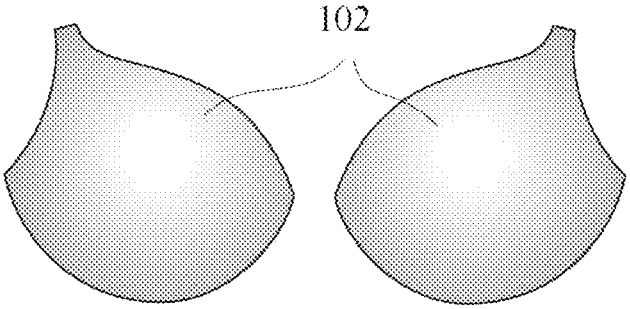
Figure 10:
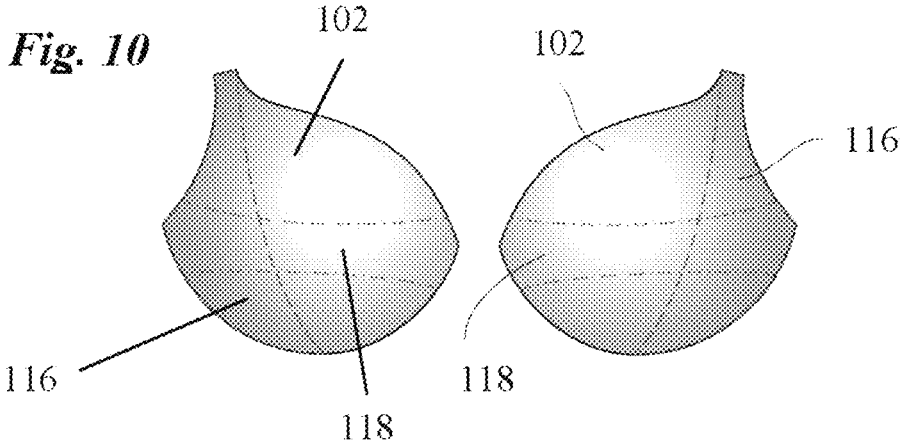
FIG. 10 shows schematically the positions of the across-sling and side-slings in the brassiere pads of FIG. 9.
Figure 11:
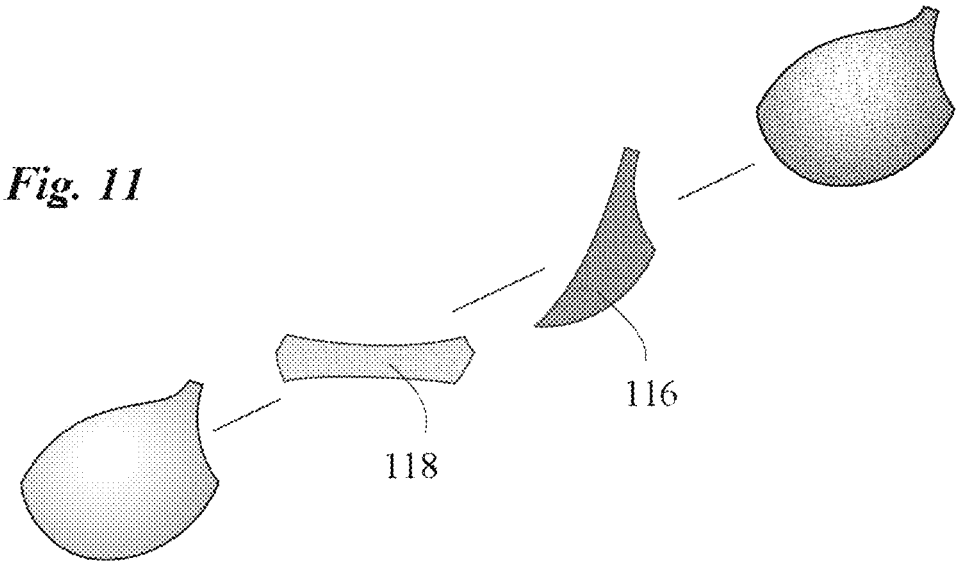
FIG. 11 is an exploded view of one of the brassiere pads of FIG. 9.

A pair of bra pads 102, as shown in FIG. 9, are then cut out from the molded laminated layer 126. These bra pads 102 are then attached to the front panel 103 (e.g. by stitching), to be joined with other parts (such as a back panel, straps and elastic) to form the padded sports brassiere 100. It can be seen in FIGS. 10 and 11 that in each of the two bra pads 102, the across-sling fabric 118 overlaps part of the side-sling fabric 116. By way of such an arrangement, the side-sling fabric 116 supports the breast from an outer side thereof, restricts side-to-side movement of the breasts, and thus assists in maintaining the breast at the front and centre during exercise; and the across-sling fabric 118 extends across the high points of the pair of breasts of the wearer to compress the pair of breasts towards the bosom of the body of the wearer, thus reducing up-and-down movement of the breasts during exercise of the wearer. It is found in practice that such inhibits the natural figure of "8" movement of the breasts during exercise by supporting the breasts from outer sides thereof and compressing the breasts at their highest points.

As the across-sling fabric 118 and the side-sling fabric 116 do not cover the entire bra pad 102, air may pass through the padded sports brassiere 100, enhancing breathability of, and thus comfort in wearing, the padded sports brassiere 100, in particular during exercise. In addition, as the across-sling fabric 118 compresses the pair of breasts of the wearer towards her own body but not downwardly, there is less discomfort to the wearer and less disfiguring of the breasts.

Figure 12:
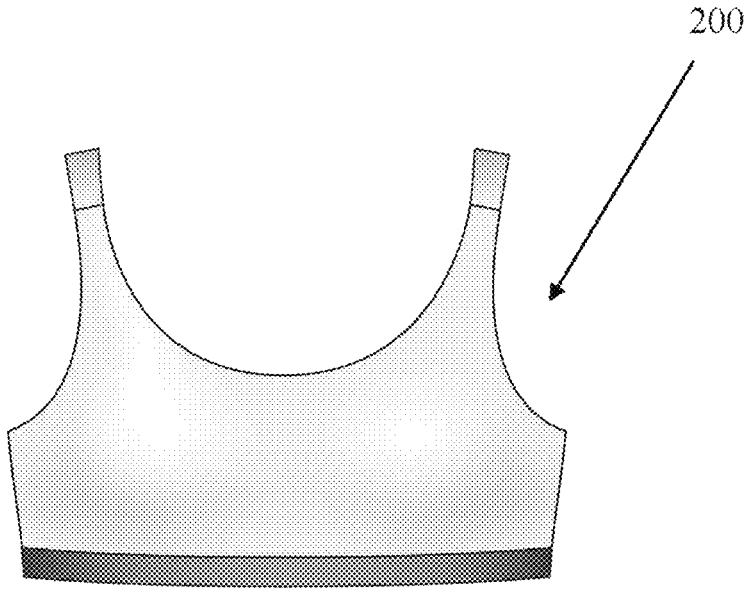
FIG. 12 is a front view of an unlined sports brassiere according to a second embodiment of the present invention.
Figure 13:
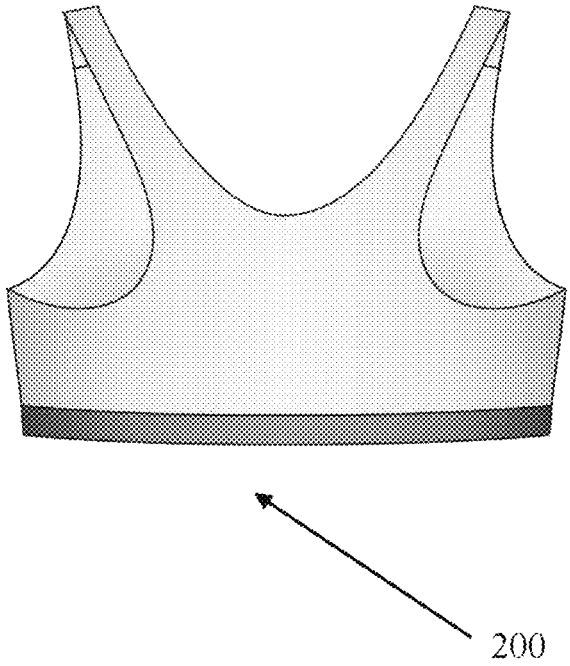
FIG. 13 is a rear view of the unlined sports brassiere of FIG. 12.
Figure 14:
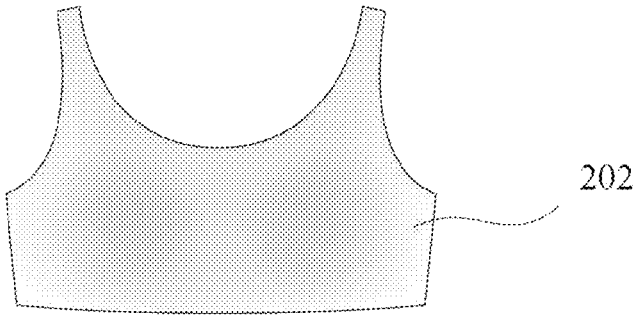
FIGS. 14 to 18 show the steps of manufacturing the unlined sports brassiere of FIG. 12.
Figure 15:
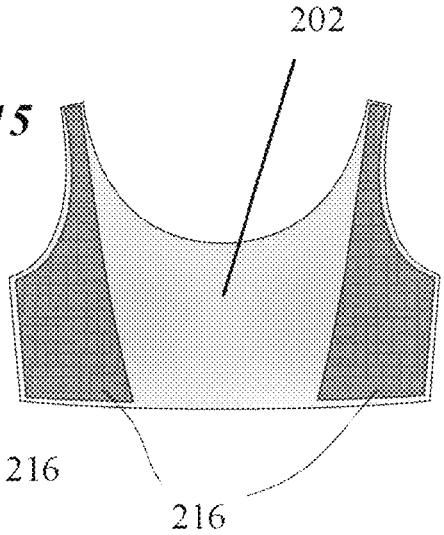
Figure 16:
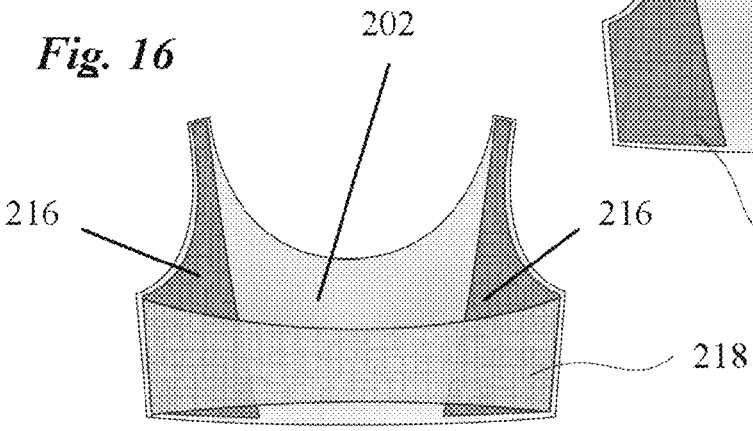
Figure 17:
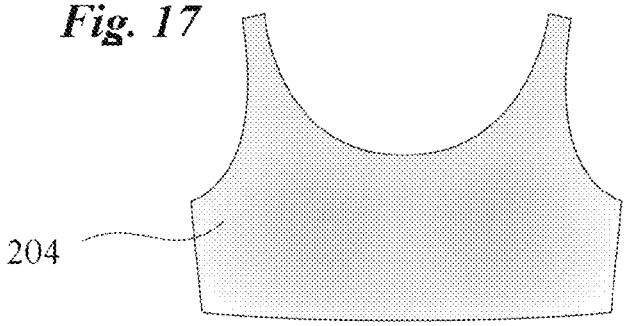

An unlined sports brassiere accordingly to a second embodiment of the present invention is shown in FIGS. 12 and 13, and generally designated as 200. Steps of manufacturing the unlined sports brassiere 200 are shown in FIGS. 14 to 18. A piece of inner fabric 202 is shown in FIG. 14. As shown in FIG. 15, two pieces of side-sling fabrics 216 are then placed on the piece of inner fabric 202. Subsequently, and as shown in FIG. 16, a piece of across-sling fabric 218 is then placed on the piece of inner fabric 202 and the two pieces of side-sling fabric 216 such that a respective longitudinal end of the piece of across-sling fabric 218 overlaps a part of a respective piece of side-sling fabric 216. It is equally possible to firstly place the piece of across-sling fabric 218 on the piece of inner fabric 202 and then place the two pieces of side-sling fabrics 216 on the piece of inner fabric 202 and the piece of across-sling fabric 218. Then the piece of inner fabric 202, the piece of across-sling fabric 218 and the two pieces of side-sling fabric 216 are fixedly engaged with one another (by sewing, heat lamination and/or an adhesive) and molded to form two cup-shaped portions.

Figure 18:
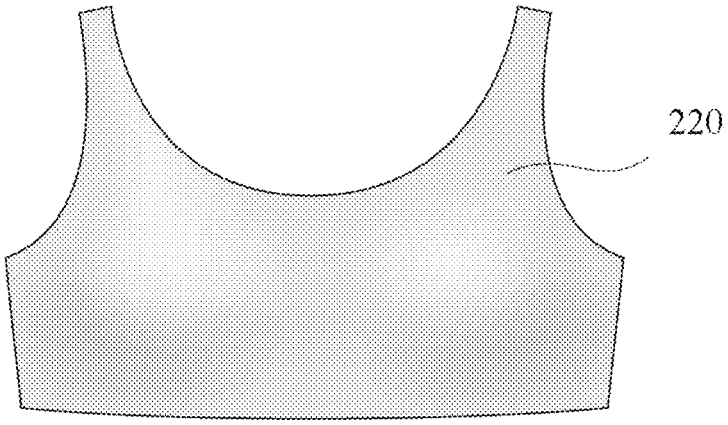

A piece of outer fabric 204 (which may optionally be pre-molded to form two cup-shaped portions) is placed on the piece of inner fabric 202 to sandwich the two pieces of side-sling fabric 216 and the piece of across-sling fabric 218 there-between. The piece of outer-fabric 204 and the piece of inner fabric 202 are then fixedly engaged with each other (by sewing, heat lamination and/or an adhesive) to form a front panel 220 of the sports brassiere 200, as shown in FIG. 18. During this process, the piece of outer-fabric 204 and the piece of inner fabric 202 are also fixedly engaged with one another, with the piece of inner fabric 202 and with the piece of outer fabric 204.

Figure 19:
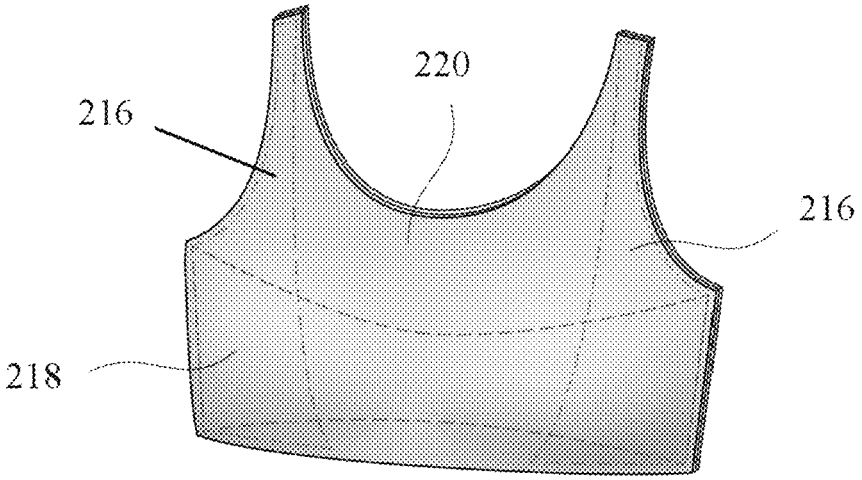
FIG. 19 shows schematically the positions of the across-sling and side-slings in the unlined sports brassiere of FIG. 18.
Figure 20:
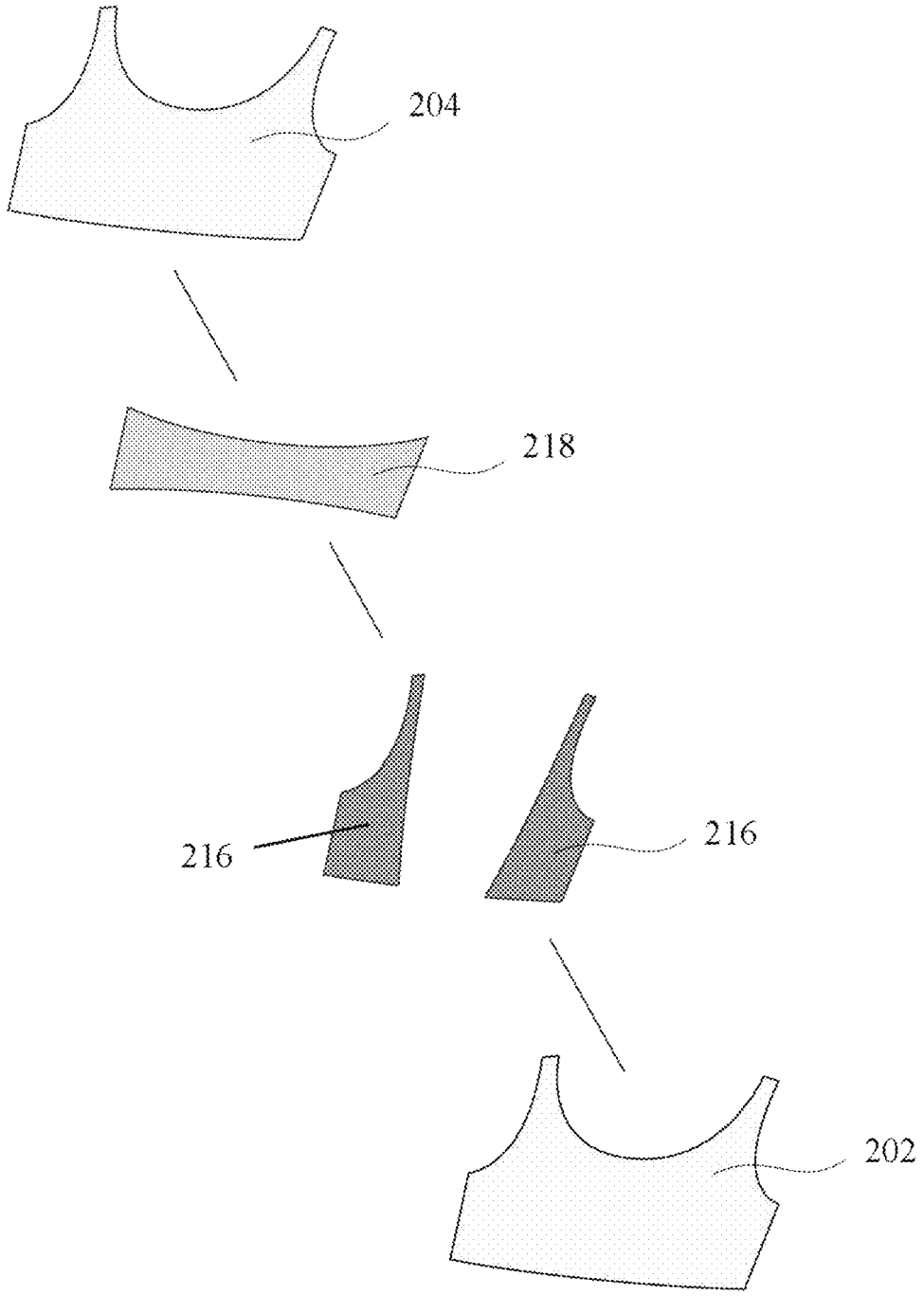
FIG. 20 is an exploded view of one of the unlined sports brassiere of FIG. 12.

As shown in FIGS. 19 and 20, in the front panel 220, the piece of across-sling fabric 218 overlaps part of each of the two pieces of side-sling fabric 216. By way of such an arrangement, the two pieces of side-sling fabric 216 support the breast from two outer sides thereof, restrict side-to-side movement of the breasts, and thus assist in maintaining the breasts at the front and centre during exercise; and the piece of across-sling fabric 218 extends across the high points of the pair of breasts of the wearer to compress the pair of breasts towards the bosom of the body of the wearer, thus reducing up-and-down movement of the breasts during exercise of the wearer. It is found in practice that such inhibits the natural figure of "8" movement of the breasts during exercise by supporting the breasts from outer sides thereof and compressing the breasts at their highest points.

As the piece of across-sling fabric 218 and the pieces of side-sling fabric 216 do not cover the entire breast part of the sports brassiere 200, air may pass through the sports brassiere 200, enhancing breathability of, and thus comfort in wearing, the sports brassiere 200, in particular during exercise. In addition, as the piece of across-sling fabric 218 compresses the pair of breasts of the wearer towards her own body but not downwardly, there is less discomfort to the wearer and less disfiguring of the breasts.

It should be understood that the above only illustrates examples whereby the present invention may be carried out, and that various modifications and/or alterations may be made thereto without departing from the spirit of the invention. It should be understood that the present invention may be worked in the context of at least brassieres, sports brassieres, crop tops, sports tops and brassiere pads.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. A garment article including:

a first layer of material, a second layer of material, and a third layer of material, wherein said first layer of material lies on top of said third layer of material, and said third layer of material lies on top of said second layer of material, wherein said third layer of material comprises a first part, a second part and a third part which collectively form a general H-shape, wherein said first part forms a horizontal portion of said general H-shape, and each of said second part and said third part forms a respective vertical portion of said general H-shape, wherein said first part is adapted to extend across and compress a pair of breasts of a wearer of said garment article towards a skin surface of said pair of breasts of said wearer, and wherein said second part and third part are adapted to support said pair of breasts of said wearer each from a respective lateral side of said respective breast.

2. The garment article according to claim 1, wherein said first part overlaps at least part of said second part and at least part of said third part.

3. The garment article according to claim 1, wherein said first layer of material comprises at least a first layer of fabric material.

4. The garment article according to claim 1, wherein said second layer of material comprises at least a second layer of fabric material.

5. The garment article according to claim 3, wherein said second layer of material comprises at least a second layer of fabric material, and wherein said first part, said second part and said third part are fixedly engaged with and in contact with said first layer of fabric material and said second layer of fabric material.

6. The garment article according to claim 3, wherein said first layer of material comprises at least a first layer of foam material fixedly engaged with said first layer of fabric material.

7. The garment article according to claim 4, wherein said second layer of material comprises at least a second layer of foam material fixedly engaged with said second layer of fabric material.

8. The garment article according to claim 6, wherein said second layer of material comprises at least a second layer of foam material fixedly engaged with said second layer of fabric material, and wherein said first part, said second part and said third part are fixedly engaged with and in contact with said first layer of foam material and said second layer of foam material.

9. The garment article according to claim 1, wherein each of said first part, said second part, and said third part is independently made of any one of stabilized block tricot, marquisette fabric, power net, satin net, two-way tricot, triskin fabric, or combinations thereof.

10. The garment article according to claim 1 wherein each of said first part, said second part, and said third part is independently made of a material with a modulus of elasticity of 1.0 to 4.0 pounds at 40% elongation, or 1.0 to 5.0 pounds at 60% elongation and a recovery of over 90%.

11. The garment article according to claim 1, wherein said garment article comprises a brassiere, a sports brassiere, a crop top, a sports top and a brassiere pad.

12. A method of manufacturing a garment or garment part including:

(a) providing a first layer of material and a second layer of material, (b) providing a third layer of material comprising a first part, a second part and a third part, (c) positioning said third layer between said first layer and said second layer such that said first part, said second part and said third part collectively form a general H-shape, wherein said first layer of material lies on top of said third layer of material, and said third layer of material lies on top of said second layer of material, and wherein said first part forms a horizontal portion of said general H-shape, and each of said second part and said third part forms a respective vertical portion of said general H-shape, and (d) fixedly engaging said first layer, said second layer and said third layer with one another.

13. The method according to claim 12, wherein said first part overlaps at least part of said second part and at least part of said third part.

14. The method according to claim 12, wherein said first layer of material comprises at least a first layer of fabric material.

15. The method according to claim 12, wherein said second layer of material comprises at least a second layer of fabric material.

16. The method according to claim 12, wherein said second layer of material comprises at least a second layer of fabric material, and wherein said first part, said second part and said third part are fixedly engaged with and in contact with said first layer of fabric material and said second layer of fabric material.

17. The method according to claim 15, wherein said first layer of material comprises at least a first layer of foam material fixedly engaged with said first layer of fabric material.

18. The method according to claim 15, wherein said second layer of material comprises at least a second layer of foam material fixedly engaged with said second layer of fabric material.

19. The method according to claim 17, wherein said second layer of material comprises at least a second layer of foam material fixedly engaged with said second layer of fabric material, and wherein said first part, said second part and said third part are fixedly engaged with and in contact with said first layer of foam material and said second layer of foam material.

20. The method according to claim 14, wherein each of said first part, said second part, and said third part is independently made of any one of stabilized block tricot, marquisette fabric, power net, satin net, two-way tricot, triskin fabric, or combinations thereof.

21. The method according to claim 14, wherein each of said first part, said second part, and said third part is independently made of a material with a modulus of elasticity of 1.0 to 2.0 pounds at 40% elongation and a recovery of over 90%.

22. The method according to claim 12, wherein said garment or garment part comprises a brassiere, a sports brassiere, a crop top, a sports top and a brassiere pad.

* * * * *